US007718035B2

(12) United States Patent
Boettcher et al.

(10) Patent No.: US 7,718,035 B2
(45) Date of Patent: May 18, 2010

(54) PHOSPHORIC ACID QUENCHED CREPING ADHESIVE

(75) Inventors: Jeffery J. Boettcher, Appleton, WI (US); Nancy S. Clungeon, Manawa, WI (US); Hung Liang Chou, Neenah, WI (US); Clay E. Ringold, Decatur, GA (US); Dexter C. Johnson, Stone Mountain, GA (US)

(73) Assignees: Georgia-Pacific Consumer Products LP, Atlanta, GA (US); Georgia-Pacific Chemicals LLC, Atlanta, GA (US)

( * ) Notice: Subject to any disclaimer, the term of this patent is extended or adjusted under 35 U.S.C. 154(b) by 1084 days.

(21) Appl. No.: 11/081,387

(22) Filed: Mar. 15, 2005

(65) Prior Publication Data

US 2006/0207736 A1 Sep. 21, 2006

(51) Int. Cl.
*B31F 1/12* (2006.01)

(52) U.S. Cl. ..... 162/112; 162/111; 162/164.3; 156/183; 264/282

(58) Field of Classification Search ..... 162/111–113, 162/158, 164.3, 166, 181.1, 164.6; 524/414, 524/417, 606, 608; 156/183; 264/282–283
See application file for complete search history.

(56) References Cited

U.S. PATENT DOCUMENTS 4,056,510 A 11/1977 Symm et al.
4,528,316 A 7/1985 Soerens
4,684,439 A 8/1987 Soerens
5,246,544 A 9/1993 Hollenberg et al.
5,256,727 A * 10/1993 Dulany et al. ..... 524/608
5,370,773 A 12/1994 Luu et al.
5,374,334 A 12/1994 Sommese et al.
5,382,323 A 1/1995 Furman, Jr. et al.
5,786,429 A 7/1998 Allen
5,833,806 A 11/1998 Allen et al.
5,942,085 A 8/1999 Neal et al.
5,981,645 A 11/1999 Hollenberg et al.
6,083,348 A 7/2000 Auhorn et al.
6,133,405 A 10/2000 Allen
6,187,138 B1 2/2001 Neal et al.
6,235,155 B1 5/2001 Schroeder et al.
6,277,242 B1 8/2001 Archer et al.
6,280,571 B1 8/2001 Allen
6,315,865 B1 11/2001 Allen et al.
6,336,995 B1 1/2002 Campbell (Continued)

FOREIGN PATENT DOCUMENTS

EP 0641818 A1 3/1995

(Continued)

*Primary Examiner*—José A Fortuna
(74) *Attorney, Agent, or Firm*—Laura L. Dozek; Michael S. Kerns

(57) ABSTRACT

An improved creping adhesive is prepared by first reacting a dibasic carboxylic acid, or its ester, half-ester, or anhydride derivative, with a polyalkylene polyamine, preferably in aqueous solution, under conditions suitable to produce a water soluble polyamide. The water-soluble polyamide is then reacted with an epihalohydrin until substantially fully cross-linked, and stabilized by acidification with phosphoric acid at the end of the polymerization reaction to form a water-soluble poly(aminoamide)-epihalohydrin creping adhesive that is re-wetable and facilitates water spray removal of buildup so as to lengthen the life of the creping blades, with attendant significant decrease in downtime and maintenance.

12 Claims, 4 Drawing Sheets

U.S. PATENT DOCUMENTS

| | | | | |
|---|---|---|---|---|
| 6,352,613 | B1 | 3/2002 | Maslanka | |
| 6,429,267 | B1 | 8/2002 | Riehle | |
| 2002/0096288 | A1 * | 7/2002 | Allen | 162/168.1 |
| 2003/0070783 | A1 | 4/2003 | Riehle et al. | |
| 2004/0266984 | A1 | 12/2004 | Riehle | |
| 2006/0065380 | A1 * | 3/2006 | Garnier et al. | 162/158 |
| 2006/0207736 | A1 * | 9/2006 | Boettcher et al. | 162/112 |
| 2007/0151684 | A1 * | 7/2007 | Grigoriev et al. | 162/111 |
| 2007/0204965 | A1 * | 9/2007 | Linhart et al. | 162/111 |
| 2008/0255320 | A1 * | 10/2008 | Allen | 525/430 |
| 2009/0133846 | A1 * | 5/2009 | Grigoriev et al. | 162/112 |
| 2009/0145565 | A1 * | 6/2009 | Esser et al. | 162/111 |

FOREIGN PATENT DOCUMENTS

| | | | |
|---|---|---|---|
| EP | 1703019 | A1 * | 9/2006 |
| WO | WO 0009806 | A2 * | 2/2000 |
| WO | WO 2007079064 | A2 * | 7/2007 |

* cited by examiner

| Sample | Description | Caliper 8 Sheet mils/ 8 sht | Basis Weight lb/3000 ft^2 | Tensile MD g/3 in | Stretch MD % | Tensile CD g/3 in | Stretch CD % | Wet Tens Finch Cured-CD g/3 in. | Tensile GM g/3 in. | Break Modulus GM gms/% | TMI Fric GMMMD 4 Scan-W Unitless | Void Volume Wt Inc. % |
|---|---|---|---|---|---|---|---|---|---|---|---|---|
| | 315D54 @ 260° F | | | | | | | | | | | |
| 2-1 | 4819-2B | 41.13 | 14.27 | 954 | 26.9 | 486 | 4.8 | 40.84 | 680 | 65.05 | 0.414 | 912.603 |
| 3-1 | 4819-2C | 43.53 | 13.90 | 692 | 25.4 | 422 | 4.0 | 31.05 | 540 | 54.35 | 0.370 | 917.533 |
| 4-1 | 4819-2D | 40.98 | 13.66 | 704 | 27.1 | 456 | 3.8 | 21.28 | 566 | 56.06 | 0.430 | 914.194 |
| 5-1 | 4819-2E | 42.00 | 13.76 | 875 | 28.4 | 463 | 3.9 | 26.83 | 636 | 60.60 | 0.474 | 862.064 |
| | **Average** | **41.91** | **13.90** | **806** | **27.0** | **457** | **4.1** | **30.00** | **606** | **59.01** | **0.42** | **901.598** |
| | **Std** | **1.17** | **0.27** | **129.38** | **1.20** | **26.57** | **0.48** | **8.26** | **64.02** | **4.81** | **0.04** | **26.44** |
| | 378G55 @ 260° F | | | | | | | | | | | |
| | 378G55 | | | | | | | | | | | |
| 6-1 | 4819-3A | 40.95 | 13.08 | 497 | 24.0 | 373 | 3.8 | 16.82 | 431 | 44.23 | 0.316 | 940.732 |
| 7-1 | 4819-3B | 41.70 | 12.96 | 523 | 24.2 | 397 | 3.8 | 26.51 | 455 | 48.43 | 0.465 | 1,033.400 |
| 8-1 | 4819-3C | 38.88 | 13.19 | 665 | 26.1 | 433 | 3.8 | 21.55 | 535 | 53.77 | 0.438 | 942.214 |
| 9-1 | 4819-3D | 39.30 | 13.48 | 680 | 27.1 | 433 | 4.3 | 19.68 | 542 | 50.10 | 0.366 | 1,000.139 |
| | **Average** | **40.21** | **13.18** | **591** | **25.4** | **409** | **3.9** | **21.14** | **491** | **49.13** | **0.40** | **979.121** |
| | **Std** | **1.34** | **0.22** | **94.70** | **1.49** | **29.37** | **0.22** | **4.07** | **56.41** | **3.96** | **0.07** | **45.55** |
| | 378G55 @ 260° F | | | | | | | | | | | |
| 10-1 | 4819-4A | 48.00 | 14.28 | 692 | 27.1 | 401 | 4.5 | 26.04 | 526 | 49.33 | 0.363 | 873.286 |
| 11-1 | 4819-4B | 45.58 | 14.62 | 724 | 27.9 | 423 | 4.5 | 22.16 | 554 | 51.33 | 0.448 | 934.544 |
| 12-1 | 4819-4C | 43.08 | 14.19 | 611 | 26.4 | 387 | 4.0 | 22.01 | 484 | 47.87 | 0.367 | 860.159 |
| 13-1 | 4819-4D | 43.75 | 14.42 | 724 | 27.6 | 459 | 4.3 | 18.53 | 574 | 50.04 | 0.437 | 877.665 |
| | **Average** | **45.10** | **14.38** | **688** | **27.2** | **418** | **4.3** | **22.19** | **535** | **49.64** | **0.40** | **886.414** |
| | **Std** | **2.20** | **0.19** | **53.30** | **0.67** | **31.34** | **0.25** | **3.07** | **38.97** | **1.44** | **0.04** | **32.94** |
| | 315D54 @ 250° F | | | | | | | | | | | |
| 14-1 | 4819-5A | 44.58 | 14.42 | 686 | 25.8 | 395 | 3.6 | 17.13 | 520 | 52.69 | 0.397 | 879.752 |
| 15-1 | 4819-5B | 46.00 | 14.21 | 660 | 27.2 | 404 | 4.3 | 24.84 | 516 | 46.57 | 0.362 | 879.334 |
| 16-1 | 4819-5C | 43.98 | 14.40 | 612 | 26.6 | 369 | 4.0 | 18.19 | 475 | 46.53 | 0.372 | 967.857 |
| 17-1 | 4819-5D | 42.65 | 14.09 | 656 | 26.7 | 363 | 4.2 | 17.75 | 488 | 44.49 | 0.360 | 904.714 |
| | **Average** | **44.30** | **14.28** | **653** | **26.6** | **383** | **4.0** | **19.48** | **500** | **47.57** | **0.37** | **907.914** |
| | **Std** | **1.39** | **0.16** | **30.78** | **0.56** | **19.91** | **0.31** | **3.60** | **22.06** | **3.55** | **0.02** | **41.69** |
| | 315D54+2% MAP@ 250° F | | | | | | | | | | | |
| 18-1 | 4819-6A | 46.55 | 14.44 | 686 | 25.9 | 347 | 4.1 | 22.54 | 488 | 48.53 | 0.397 | 931.209 |
| 19-1 | 4819-6B | 45.50 | 14.29 | 720 | 26.5 | 387 | 3.9 | 21.90 | 527 | 50.74 | 0.435 | 926.159 |
| 20-1 | 4819-6C | 41.48 | 14.17 | 727 | 25.6 | 422 | 4.2 | 21.95 | 553 | 54.13 | 0.355 | 920.881 |
| 21-1 | 4819-6D | 42.58 | 14.06 | 741 | 26.1 | 448 | 4.3 | 26.70 | 576 | 53.62 | 0.318 | 913.953 |
| | **Average** | **44.03** | **14.24** | **719** | **26.0** | **401** | **4.1** | **23.27** | **536** | **51.75** | **0.38** | **923.051** |
| | **Std** | **2.39** | **0.16** | **23.40** | **0.37** | **43.80** | **0.19** | **2.30** | **37.95** | **2.62** | **0.05** | **7.39** |

Note: MD Tensile - Machine Direction Tensile in g/3" of sample
CD Tensile - Cross Machine Direction Tensile in g/3" of sample
GM Tensile - Square Root of (MDT x CDT)
Break GM Modulus - Square Root of ((MD Tensile/MD Stretch)*(CD Tensile/CD Stretch))
The most significant differences between those data is GM Modulus which is one of two key parameters to predict finished product softness.

*FIG. 4*

PHOSPHORIC ACID QUENCHED CREPING ADHESIVE

FIELD OF INVENTION

The invention is in the field of polyamide-epihalohydrin creping adhesives

BACKGROUND OF THE INVENTION

In the manufacture of tissue and towel products, a common step is creping the product to provide desired aesthetic and performance properties to the product. Creping is commonly used in both the conventional wet press and through air drying processes. Many of the aesthetic properties of tissue and towel products rely more upon the perceptions of the consumer than on properties that can be measured quantitatively. Such things as softness, and perceived bulk are not easily quantified, but have significant impacts on consumer acceptance. However both softness and bulk are dramatically improved by the creping process. Creping is generally accomplished by mechanically foreshortening or compacting paper in the machine direction with a flexible blade, a so-called doctor blade, against a Yankee dryer in an on-machine operation. This blade is also sometimes referred to as a creping blade or simply a creper. By breaking a significant number of interfiber bonds and slowing down the speeds between the Yankee and the reel, creping increases the basis weight (mass per unit area) of the paper and effects significant changes in many physical properties, particularly when measured in the machine direction. Creping thus enhances bulk and stretch, and increases the perceived softness of the resulting product.

A Yankee dryer is a large diameter, generally 8-20 foot drum which is designed to be pressurized with steam to provide a hot surface for completing the drying of papermaking webs at the end of the papermaking process. The paper web which is first formed on a foraminiferous forming carrier, such as a Fourdrinier wire, where it is freed of the copious water needed to disperse the fibrous slurry, then is usually transferred to a felt or fabric either for dewatering in a press section where de-watering is continued by mechanically compacting the paper or by some other water removal method such as through-drying with hot air, before finally being transferred in the semi-dry condition to the surface of the Yankee for the drying to be completed. Before transferring to the Yankee dryer, an adhesive is applied directly to the Yankee dryer.

Obtaining and maintaining adhesion of tissue and towel products to Yankee dryers is an important factor in determining crepe quality. Re-wetability, doctorability, and the level of adhesion are important properties of a creping adhesive. The ability of the adhesive to be rewet on the surface of the dryer helps to prevent buildup on the drum and on the creping blade. Inadequate adhesion results in poor creping, sheet floating, and poor sheet handling whereas excessive adhesion may result in crepe blade picking, sheet plugging behind the crepe blade, and sheet breaks due to excessive tension. Traditionally, creping adhesives alone or in combination with release agents and/or modifiers have been applied to the surface of the dryer in order to provide the appropriate adhesion to produce the desired crepe. The adhesive coating also serves the purpose of protecting the Yankee dryer and creping blade surfaces from excessive wear. In this role, the coating agents provide improved runnability of the tissue machine. As creping blades wear, they must be replaced with new ones. This replacement process represents a significant source of tissue machine downtime, or lost production.

Various types of creping adhesives have been used to adhere fibrous webs to dryer surfaces such as Yankee dryers. Some examples of prior art creping adhesives rely upon combinations of self-crosslinkable soft polymers with a non-film forming hard polymer emulsion (U.S. Pat. No. 4,886,579). Some others involve thermoset resins (U.S. Pat. Nos. 4,528,316 and 4,501,640). The ability to control the mechanical properties of the polymers, as well as the adhesion and release of the fibrous web from the Yankee dryer, is limited when using these types of creping adhesives. A variety of proposals have been made in an attempt to improve the properties of certain adhesives. For example, U.S. Pat. No. 5,370,773 describes the use of a phosphate surfactant with an adhesive composition that includes a non-self-crosslinkable polymer or oligomer having functional groups that can be ionic crosslinked using a high valence metallic crosslinking agent. U.S. Pat. No. 6,280,571 describes the use of an acid selected from hypophosphorous acid, phosphorous acid, hypodiphosphoric acid, diphosphorous acid, hypophosphoric acid, pyrophosphorous acid, or their salts, to stabilize a polymer selected from polyamidoamine-epichlorohydrin resin, polyamine-epichlorohydrin resin, reaction products of epichlorohydrin with highly branched polyamidoamines and polyvinyl alcohol.

Poly(aminoamide)-epihalohydrin type creping adhesives (also referred to as PAE resins), exemplified by poly(aminoamide)-epichlorohydrin, provide a class of resins distinct from the above polymers. Resins of this type have been used for many years in paper making and are described in U.S. Pat. Nos. 2,926,116 and 3,058,873, the disclosure of which are incorporated herein by reference. They are generally prepared by reacting an epihalohydrin and a polyamide containing secondary or tertiary amine groups, followed by stabilizing the reaction products by acidification with sulfuric or hydrochloric acid. They have very useful properties when freshly applied in runnability and initial re-wetability and doctorability. However, a problem with the poly(aminoamide)-epihalohydrin type creping adhesives is the phenomenon of coating buildup. This problem is evidenced by high spots in the coating on the Yankee and/or build up on the rear surface of the blade, particularly along the edges or corners of the creping blade, which can cause chattering, or bouncing of the blade. Ultimately, portions of the sheet may travel underneath the creping blade, causing picks or holes in the sheet leading to sheet breaks and machine downtime. Commonly water sprays have been used to remove or minimize adhesive buildup, but eventually may prove inadequate.

In order to produce a bulky and soft tissue with conventional wet press paper machines, the paper sheet is preferably dried to very low moisture levels (e.g., less than 3%), thus economic considerations often require an adhesive that will perform at very high sheet temperatures. But the foregoing problems with the poly(aminoamide)-epihalohydrin type creping adhesives can be particularly severe at higher temperatures.

Another difficulty with PAE resins is the adverse effect of sizing agents such as alkyl ketene dimer (AKD), alkylene ketene dimers and alkylene succinic anhydride (ASA) on the creping process. These sizing agents, particularly AKD, are sometimes added to paper webs to impart moisture resistance properties for some special grades of paper. However, AKD performs as a strong release on the Yankee. When AKD is added to the furnish in the wet end, most of the PAE adhesives have issues in generating sufficient adhesion between the Yankee surface and the sheet often resulting in poor creping and sheet handling issues or limiting the amount of these sizing agents that can be incorporated into the sheet if good creping is desired.

SUMMARY OF THE INVENTION

The present invention provides an improved method for manufacturing tissue using an improved poly(aminoamide)-epihalohydrin creping adhesive that is re-wetable, and that reduces buildup, or facilitates its removal, with attendant significant decrease in downtime and maintenance. Moreover, we have discovered that, in one particularly demanding application, the creping adhesive of the present invention provides a particularly impressive improvement. When tissue substrates, such as might be used in napkin basestock, are treated with sizing agents such as AKD, they can become particularly difficult to crepe. We have found that the creping adhesives of the present invention provide dramatically improved creping performance when used with AKD treated base sheets, such as are disclosed in U.S. application Ser. No. 10/995,457 filed Nov. 22, 2004 entitled "Multi-Ply Paper Product With Moisture Strike Through Resistance And Method Of Making The Same."

The adhesive is prepared in the usual manner of preparing poly(aminoamide)-epihalohydrin creping adhesives with a change in one step, a change that appears to be simple, yet which, very surprisingly, results in essentially substantial alleviation of the problems of adhesive buildup. This is accomplished at the end of the polymerization reaction, at the quenching step, by replacing the usual sulfuric acid or hydrochloric acid with phosphoric acid.

More particularly, a poly(aminoamide)-epihalohydrin creping adhesive is prepared by first reacting a dibasic carboxylic acid, or its ester, half-ester, or anhydride derivative, with a polyalkylene polyamine, preferably in aqueous solution, under conditions suitable to produce a water soluble polyamide. The water-soluble polyamide is then reacted with an epihalohydrin until substantially fully cross-linked, and stabilized by acidification with phosphoric acid at the end of the polymerization reaction to form the water-soluble cationic polyamide-epihalohydrin resin of this invention. The epihalohydrin used in preparing the phosphoric acid stabilized poly(aminoamide)-epihalohydrin resin is preferably epichlorohydrin, to prepare a phosphoric acid stabilized poly(aminoamide)-epichlorohydrin resin.

The manufacturing method includes applying a creping adhesive to the surface of a Yankee dryer, while using a felt or carrier fabric to apply a preformed nascent fibrous paper web to the creping adhesive on the surface of the dryer, thereafter removing the paper web from the Yankee dryer by use of a creping blade and winding the dried paper onto a roll. The method may optionally also include applying water or a modifier, e.g., by spraying, to the exposed edges of the Yankee drum directed principally against the drum surfaces not contacted by the felt or carrier fabric, to control buildup.

BRIEF DESCRIPTION OF DRAWINGS

FIG. 4 is a table showing a comparison of the physical properties tissue produced using the phosphoric acid stabilized adhesive of this invention as compared to tissue produced using the sulfuric acid stabilized adhesive.

DETAILED DESCRIPTION OF THE INVENTION

Figure 1:
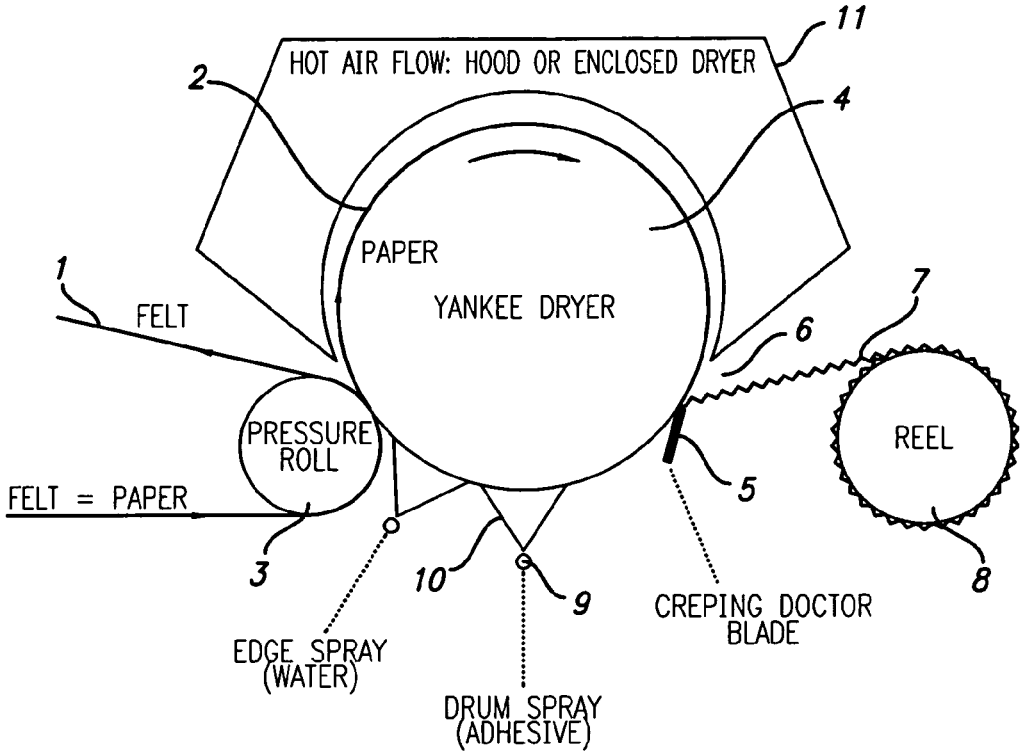
FIG. 1 is a schematic illustration of a Yankee dryer to which a tissue web is presented, dried, creped, and then wound into a soft roll.

FIG. 1 illustrates steps in formation of a tissue paper web suitable for use as a facial tissue. The method illustrated is a schematic example only and is not meant to indicate or infer any limitations on the method, but is only meant to illustrate the method in broad terms, representing one of a number of possible configurations used in processing tissue or towel products. The manufacturing method includes applying a creping adhesive to the surface of a Yankee dryer, using a felt or carrier fabric to apply a preformed fibrous nascent web to the creping adhesive on the surface of the dryer, drying the nascent web to form a paper web on the surface of the Yankee and, thereafter, removing the paper web from the Yankee dryer by use of a creping blade and winding the dried paper onto a roll. The method optionally also includes applying water or modifier, e.g., by spraying, to exposed edges of the Yankee drum, i.e., drum surfaces not contacted by the felt or carrier fabric.

In this particular arrangement, transfer and impression felt carrier fabric designated at 1 carries the nascent, dewatered paper web 2 around turning pressure roll 3 to the nip between the pressure roll 3 and Yankee dryer drum 4. The fabric, web and dryer move in the directions indicated by the arrows. The entry of the web to the dryer is well around the drum 4 from a creping doctor blade 5 which, as schematically indicated at 6, crepes the traveling web from the dryer. Creped web 7 exiting from the dryer is wound into a soft creped tissue reel 8. To adhere nascent web 2 to the surface of the dryer, spray boom 9 sprays adhesive 10 directly onto the outer surface of the internally heated Yankee drum 4. Additionally, hot air flow is applied to the adhered paper web by a hood 11. Suitable apparatus for use with the present invention are disclosed in U.S. Pat. Nos. 4,304,625 and 4,064,213, which are hereby incorporated by reference.

The apparatus can be configured so that the felt or carrier fabric 1 is of a dimension sufficient to entirely cover the surface of the drum 4 contacted by the doctor blade 5. If it not so dimensioned, which is typically the case, then in accordance with a preferred embodiment of the invention, possible in substantial part by the superior re-wetability of the adhesive obtained by the use of a phosphoric acid quenching step, water or modifier is applied to the exposed edge(s). An edge spray 12 can be used to apply a water spray 13 to the exposed side edge or edges of the drum, i.e., on the drive side and/or operator side of the adhesive coated Yankee drum, as the case may be.

This illustration does not incorporate all the possible configurations used in presenting a nascent web to a Yankee dryer. It is used only to describe how the adhesive of the present invention can be used to promote adhesion and thereby influence the crepe of the product. The present invention can be used with all other known processes that rely upon creping the web from a creping surface. In the same manner, the method of application of the adhesive to the surface of the dryer or the web is not restricted to spray applications, although these are generally the most expedient for adhesive application.

The present invention is useful for the preparation of fibrous webs which are creped to increase the thickness of the web and to provide texture to the web. The invention is particularly useful in the preparation of final products such as facial tissue, napkins, bath tissue, paper towels and the like. The fibrous web can be formed from various types of wood pulp based fibers which are used to make the above products such as hardwood kraft fibers, softwood kraft fibers, hardwood sulfite fibers, softwood sulfite fibers, high yield fibers such as chemi-thermo-mechanical pulps, thermomechanical pulps, or refiner mechanical pulps and the like. Furnishes used may also contain or be totally comprised of recycled fibers (i.e., secondary fibers). The fibrous web, prior to application to the Yankee dryer, usually has a water content of 40 to 80 wt. %, more preferably 50 to 70 wt. %. At the creping stage, the fibrous web usually has a water content of less than 7 wt. %, preferably less than 5 wt. %. The final product, after creping and drying, has a basis weight of 7 to 80 pounds per ream.

The creping operation itself can be conducted under conventional conditions except that the creping adhesive of the present invention is substituted for a conventional creping adhesive.

In accordance with this invention, an improved poly(aminoamide)-epihalohydrin creping adhesive that is re-wetable and facilitates water spray removal of buildup so as to lengthen the life of the creping blades, with attendant significant decrease in downtime and maintenance. The adhesive is prepared in the usual manner of preparing poly(aminoamide)-epihalohydrin creping adhesives with a change in one step, a change that appears to be simple, yet which, very surprisingly, results in substantial alleviation of the problems of adhesive buildup; and, in many cases, makes it possible for the creping package to provide an increased level of adhesion producing a softer more flexible creped sheet as reflected by a decreased tensile modulus. This change is accomplished at the end of the polymerization reaction, at the quenching step, by replacing the usual sulfuric acid or hydrochloric acid with phosphoric acid.

More particularly, a poly(aminoamide)-epihalohydrin creping adhesive is prepared by first reacting a dibasic carboxylic acid, or its ester, half-ester, or anhydride derivative, with a polyalkylene polyamine, preferably in aqueous solution, under conditions suitable to produce a water soluble polyamide. To form the water-soluble cationic polyamide-epihalohydrin resin of this invention, the water-soluble polyamide is then reacted with an epihalohydrin, and stabilized by acidification with phosphoric acid at the end of the polymerization reaction, preferably with 85% ortho-phosphoric acid, 0.1-2.0 molar equivalent based on polymer content to a pH of 3.5-7.0, most preferably to 7.0. Acidification quenches the epihalohydrin cross-linking reaction, in which molecular weight is built, to prevent gelation. The acid salts of the remaining amine groups in the polymer backbone are less reactive toward the azetidinium rings than were the free amines at the higher pH before quenching.

The extent of cross-linking, whether partial or fully cross-linked, can be controlled with reaction conditions. For fully cross-linked polymer, epihalohydrin is added in aliquots to base polymer and reacted at high temperature at each stage until there is viscosity "burn-out", with no more advancement. The polymer is then acidified, ensuring that the difunctional epihalohydrin has reacted completely with prepolymer. The correct viscosity end point is determined by carefully controlling the amount of epihalohydrin added. For partial cross-linking, a small excess of epihalohydrin is added (compared to fully cross-linked, either in aliquots or at once) and reacted to a pre-determined viscosity end point before the reaction burns out. The viscosity advancement is halted at the determined end point by addition of acid. This ensures that the epihalohydrin is not completely cross-linked and that some residual pendant chlorohydrin remains.

We can distinguish differences in the degree of cross-linking with total and ionic chloride titrations. C-13 NMR can detect pendant chlorohydrin present in partially cross-linked resins. Also, the viscosity of the partially cross-linked material can be made to advance with heat, and can change during storage while fully cross-linked materials are far more stable over time.

The polyalkylene polyamine preferably has the repeating units $$—NH(C_nH_nHN)_x—CORCO—$$

where n and x are each 2 or more and R is the divalent hydrocarbon radical of the dibasic carboxylic acid or its derivative containing from about 3-10 carbon atoms. The polyamide secondary amine groups are preferably derived from a polyalkylene polyamine for example polyethylene polyamides, polypropylene polyamines or polybutylene polyamines and the like, with diethylenetriamine being preferred.

Poly(aminoamide)-epihalohydrin resins undergo at least two types of reactions that contribute to wet strength. One reaction involves the reaction of an azetidinium group in one molecule with an unreacted secondary amine group in another molecule to produce a cross-link between the two molecules. In the second reaction at least two azetidinium groups on a single resin molecule react with carboxyl groups on two different fibers to produce an interfiber cross-link. It is also known to utilize promoters such as carboxymethyl cellulose to enhance the performance of these materials in paper products.

The dicarboxylic acid is one of the saturated aliphatic dibasic carboxylic acids containing from about 3 to about 10 carbon atoms. Examples are malonic, succinic, glutaric, adipic, pimelic, suberic, azelaic, and sebacic dicarboxylic acids, and mixtures thereof. Examples of ester, half-ester, or anhydride derivatives of adipoc acid are dimethyl adipate, diethyl adipate, adipic acid monomethyl ester, adipic acid monoethyl ester, and adipic acid anhydride. Corresponding esters, half esters, and anhydrides of each of the listed dibasic acids are further examples. Blends of two or more of derivatives of dibasic carboxylic acids may also be used, as well as blends of one or more derivatives of dibasic carboxylic acids with dibasic acids. Dicarboxylic acids containing from 4 to 8 carbon atoms, and their derivatives, are preferred, with adipic acid (hexanedioic acid) being most preferred. Preferably the mole ratio of polyalkylene to dibasic carboxylic acid, or equivalent amount of its derivative, is from about 0.8 to 1 to about 1.5 to 1. The mole ratio of epihalohydrin to secondary amine groups in the polyamide is preferably from about 0.01 to 1 to about 2 to 1.

The epihalohydrin used in preparing the poly(aminoamide)-epihalohydrin resin is preferably epichlorohydrin, to prepare a phosphoric acid stabilized poly(aminoamide)-epichlorohydrin resin.

Finally, as a last step, the poly(aminoamide)-epihalohydrin resin is stabilized by acidification to a pH of 3.5-7.0, preferably to 7.0, at the end of the polymerization reaction. In accordance with this invention, in place of the usual acidification with sulfuric acid, or in some cases with hydrochloric acid, the poly(aminoamide)-epihalohydrin resin is stabilized with phoshoric acid. Preferably, it is stabilized with 85% ortho-phosphoric acid, 0.1-2.0 molar equivalent based on polymer content phosphoric acid, to a pH of 3.5-7.0, most preferably to 7.0.

The following Examples are illustrative of, but are not to be construed as limiting, the invention embodied therein.

Example 1

Synthesis of Polyamide Prepolymer

A 2.5 l (2.5 liter) reactor equipped with hot oil bath, stainless steel stirring shaft, agitator, thermometer and a reflux condenser with nitrogen inlet. The reactor condenser was configured for reflux. 990.2242 grams of liquid DETA (diethylenetriamine) were loaded to the reactor at 25° C. and atmospheric pressure. To this was added 1446.0327 grams of solid adipic acid over a 30 minute period in six equal portions with agitation and at atmospheric pressure. The reaction was exothermal, raising the temperature from 40° C. to about 147° C. during the course of adipic acid additions. After the adipic acid load was complete, the reactor condenser was switched from reflux to distillation and heat was applied to raise the reaction temperature to a maximum of 165° C. Water began to distill from the reaction mixture at about 160° C., and heat was supplied to slowly ramp-up the reaction temperature to a maximum temperature of 165° C. Once the desired degree of polymerization was obtained as determined by check-cut viscosity tests (i.e., comparing the viscosity of small samples taken during this polymerization to the viscosity of a sample having a known degree of polymerization obtained during a previous synthesis) the condenser was then switched back to reflux, and fresh water was gradually loaded to the molten prepolymer at 158° C. and atmospheric pressure. The addition of water brought the prepolymer to about 66% concentration and reduced the reaction temperature to about 100° C. The prepolymer was then diluted to 45% non-volatiles, and the viscosity was 290 cP by Brookfield.

Example 2

Synthesis of Phosphoric Acid Stabilized Crepe Adhesive

To a 5 l glass reactor equipped with stirring shaft, stainless steel cooling coils, heating mantle, reflux condenser, pH/temperature probe, and equal pressure addition funnel was added 3295.71 grams of polyamide prepolymer from Example 1. To this was added 1372.32 grams of water. The mixture was then heated to 40° C. 23.24 grams of epichlorohydrin was added via addition funnel to the heated mixture in 2 aliquots over a 2 hour period. After addition of the first aliquot of epichlorohydrin the reaction was heated to 90° C. The viscosity of the mixture was monitored with Gardner-Holdt bubble tubes every ten minutes over the 2 hour period. The reaction mixture advanced to a maximum of GH Gardner-Holdt bubble tube viscosity. When the viscosity ceased to advance further with continuous heating at 90° C., the reaction mixture was cooled to 25° C. and 407 grams of 85% phosphoric acid was slowly added to adjust the pH of the mixture to 7.0. Water was added to dilute the finished polymer mixture to 35% non-volatile content, with a Brookfield viscosity of 150 cP and pH 7.0

Example 3

Synthesis of Prior Art Sulfuric Acid Stabilized Crepe Adhesive

To a 2.5 l glass reactor equipped with stirring shaft, stainless steel cooling coils, heating mantle, reflux condenser, pH/temperature probe, and equal pressure addition funnel was added 1647.86 grams of polyamide prepolymer from Example 1. To this was added 686.16 grams of water. The mixture was then heated to 40° C. 14.32 grams of epichlorohydrin, was added via addition funnel to the heated mixture in 3 aliquots over a 2 hour period. After addition of the first aliquot of epichlorohydrin the reaction was heated to 90° C. The viscosity of the mixture was monitored with Gardner-Holdt bubble tubes every ten minutes over the 2 hour period. The reaction mixture advanced to a maximum of GGH Gardner-Holdt bubble tube viscosity. When the viscosity ceased to advance further with continuous heating at 90° C., the reaction mixture was cooled to 25° C. and 116.52 grams of 93% sulfuric acid was slowly added to adjust the pH of the mixture to 7.0. Water was added to dilute the finished polymer mixture to 35% non-volatile content, with a Brookfield viscosity of 130 cP and pH 7.0.

Physical Properties of the Adhesives

Physical properties of the formulations of Example 2 (denoted 378G55) and Example 3 (denoted 315D54), are shown in Table 1. The materials were analyzed for molecular weight based on poly(vinyl pyridine) standards. To determine weight % solids, weighed portions of each sample were dried for 4 hours at 105° C. in a weighed aluminum pan. The dried samples were cooled and weighed again to determine water loss. For C-13 NMR analysis, 2.8 ml of the adhesive was combined with 0.4 ml of D2O and TSP in an NMR tube. Quantitative C-13 and P-31 NMR spectra were taken at 25° C. on a Varian UNITY® 300 MHz NMR using standard suppressed nuclear Overhauser conditions. For P-31 NMR analysis, the samples were first screened for the presence of phosphorus by obtaining a broad band spectrum, the samples that contained phosphorus were then quantitatively analyzed after they were spiked with a known amount of trimethyl phosphate. Corresponding properties of four typical commercial poly(aminoamide)-epichlorohydrin adhesives designated in Table 1 as PAE H, PAE CT, PAE R, AND PAE C are included for comparison.

TABLE 1

| Sample ID | Number Average (MN) | Peak Mol. Wt. (Mp) | Weight Average (Mw) | Z-Average (Mz) | Poly-dispersity (Mw/Mn) | Azetidinium Mol % DETA | Charge (meq/g) |
|---|---|---|---|---|---|---|---|
| 378G55 | 2260 | 3320 | 24,400 | 119,100 | 10.8 | 0 | 0 |
| 315D54 | 1950 | 3410 | 18,100 | 79,400 | 9.29 | 0 | 0 |
| PAE H | 1310 | 970 | 90,800 | 614,300 | 69.2 | 2.9 | 0.11 |
| PAE CT | 2630 | 2630 | 127,300 | 719,300 | 48.5 | 23.8 | 0.88 |
| PAE R | 1720 | 2450 | 114,500 | 666,700 | 66.5 | 6.3 | 0.21 |
| PAE C | 3000 | 2650 | 131,000 | 689,500 | 43.6 | 4.1 | 0.16 |

In addition to the advantages in re-wetability provided by phosphoric acid stabilization, the data in Table 1 demonstrates that because 378G55 is fully cross-linked, it has developed quite a bit of both dry and wet adhesion. Moreover, it has relatively lower molecular weight than the typical commercial PAE adhesives (i.e., ⅙ or less in Mz), it has minimal or no charge density, and nondetectable residual azetidinium. As a result, it is not subject to thermosetting and therefore is much softer than commercial PAE adhesives when the creping temperature is high. The beneficial effect of cross-linking on dry and wet adhesion of the is shown by the dry and wet tack results in Table 2, in which the formulations of Examples 2 (378G55) and 3 (315D54) are compared to partially cross-linked adhesives. It is evident that both high and low molecular weight partially cross-linked adhesives did not perform as well as the fully cross-linked adhesives.

TABLE 2

| Ref. | Adhesive | Backbone | Solids | pH | Acid | X-Link | Mol. Wt. × 1000 | Dry Tack | Wet Tack | Rewet |
|---|---|---|---|---|---|---|---|---|---|---|
| 13/A | 378G55 | Adipic | 35 | 7 | Phosphoric | Full | 90 | 10 | 10 | Dissolves |
| 13/E | 315D54 | Adipic | 35 | 7 | Sulfuric | Full | 90 | 7 | 10 | Dissolves |
| 7649/58/S | 457T20 | Adipic | 15 | 7 | Sulfuric | Full | 325 | 5 | 7 | Swells |
| 13/B | 473G03 | Adipic | 15 | 4 | Phosphoric | Partial | 325 | 2 | 2 | Swells |
| 13/C | 473G05 | Adipic | 35 | 7 | Phosphoric | Partial | 90 | 3 | 2 | Slow Swell |
| 13/D | 378G95 | Glutaric | 15 | 4 | Phosphoric | Partial | 250 | 2 | 2 | Swells |
| 7649/58/M | C77 | Glutaric | 15 | 4 | Sulfuric | Partial | 250 | 6 | 3 | Dissolves |

While both low molecular weight fully cross-linked phosphoric acid quenched adhesive had good wet tack values, the phosphoric acid based adhesive displayed significantly better dry tack values.

Example 4

Figure 2:
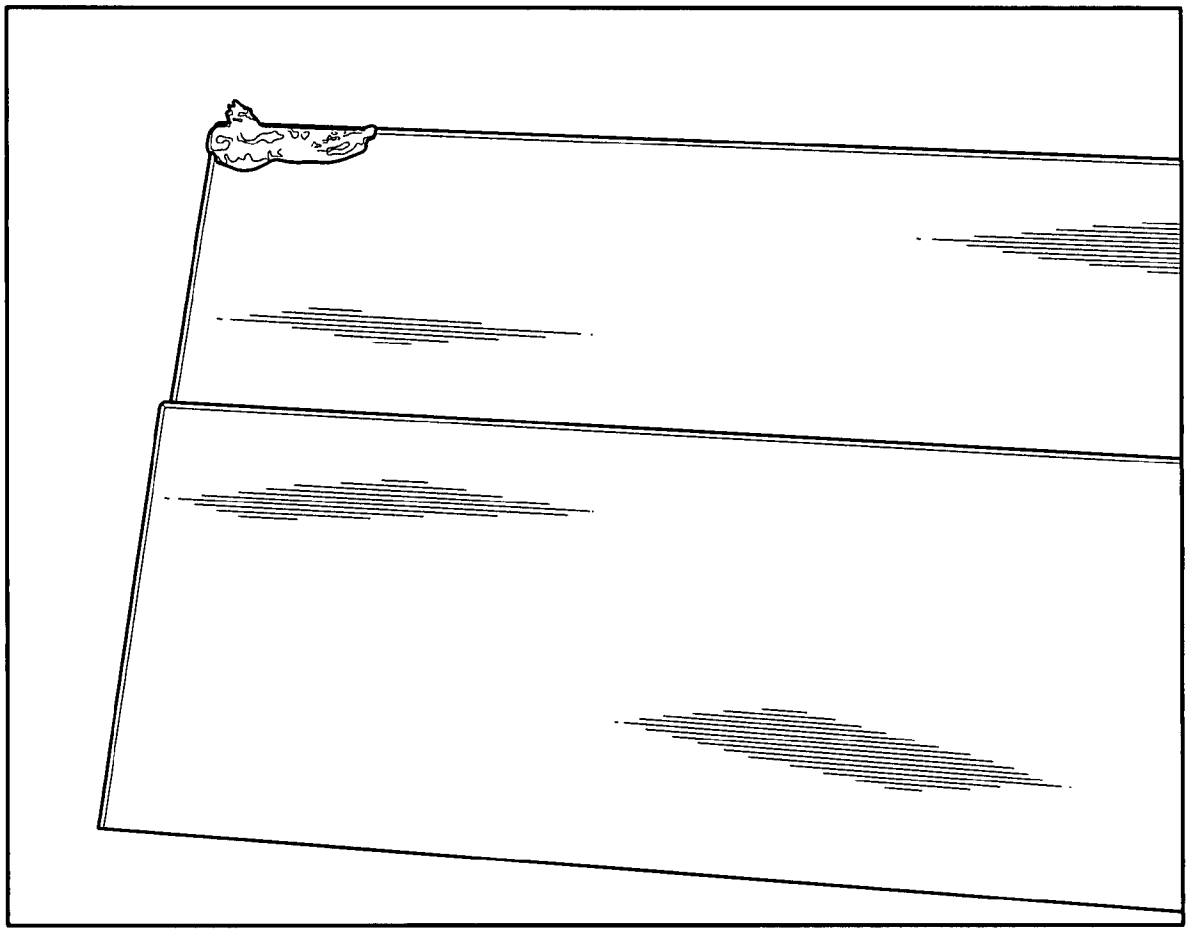
FIG. 2 is a photograph showing the drive sides, left in the photograph, of two crepe blades run for about 80 minutes, with a sulfuric acid stabilized poly(aminoamide)-epichlorohydrin adhesive on the top blade in the photograph, and with phosphoric acid stabilized poly(aminoamide)-epichlorohydrin adhesive of this invention on the bottom blade.
Figure 3:
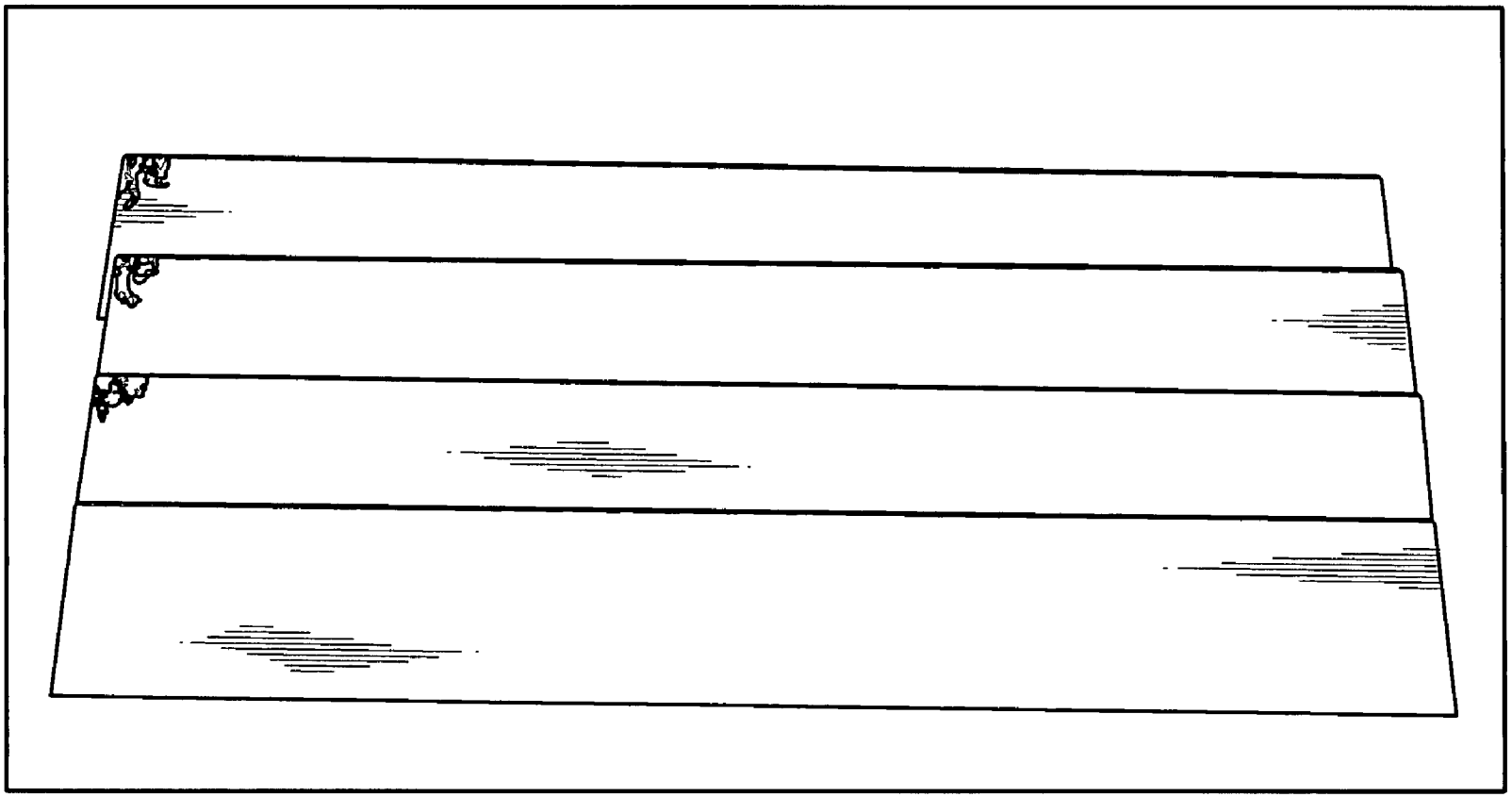
FIG. 3 is a photograph of the drive and operator sides, respectively left and right sides in the photograph, of 3 blades run with the phosphoric acid stabilized poly(aminoamide)-epichlorohydrin adhesive of this invention, from top to bottom with sorbitol modifier at 5 wt. % of adhesive solids, 10 wt. % of adhesive solids, and 20 wt. % of adhesive solids for about 100 minutes each, the bottommost blade showing the effect of water spray on the adhesive with sorbitol modifier at 10 wt. % of adhesive solids.

Comparing the Phosphoric Acid Stabilized Adhesive to Prior Art Sulfuric Acid Stabilized Crepe Adhesive The formulations of Examples 2 and 3 were used in runs preparing tissue on a Yankee drum with apparatus in which the carrier fabric did not extend to the entire drive and operator sides, leaving drive and operator edges exposed. Referring to FIG. 2, the top blade was run with the sulfuric acid stabilized adhesive of Example 3, while the bottom was run with the phosphoric acid stabilized adhesive of Example 2. Each blade was run for 4 reels, about 80 minutes. As shown in FIG. 2, the phosphoric acid stabilized adhesive did not build a hard coating on the edges of the rear blade surface when a water spray at 20 psi was applied on the edges of the Yankee surface. Under the same conditions, the sulfuric acid stabilized adhesive built hard coating on both edges of the rear blade surface. This demonstrates that the phosphoric acid stabilized adhesive is re-wetable while the sulfuric acid stabilized adhesive did not exhibit sufficient re-wetability to remove the build up. This result is quite significant because coating build-up on the edges of the blade can often result in sheet plugging, picking, and scuffing.

Differences between the two adhesives on key physical properties are also seen in the table of FIG. 4, which shows a comparison of the physical properties of tissue produced using the phosphoric acid stabilized adhesive of Example 2 (denoted 378G55) as compared to tissue produced using the sulfuric acid stabilized adhesive of Example 3 (denoted 315D54). At high temperatures, 378G55 is more re-wetable than 315D54 as indicated by not having significant edge coating build-up of the creping blade at the sheet temperature of 257° F. under water edge spray. The 315D54 had quite a bit of coating build-up on the edges of the creping blade at 260° F. even under a similar water edge spray. However, the edge coating build-up reduced with 315D54 when the sheet temperature is reduced to 250° F. This improved wet-ability provided a considerable improvement in adhesion resulting in a softer sheet as reflected by a significant reduction in base sheet GM Modulus when the adhesive was switched from 315D54 (i.e., GM Modulus of 59 g/%) to 378G55 (i.e., GMM of 49.6 g/%) at the sheet temperature close to 260° F. However, when the sheet temperature dropped to 250° F., the base sheet produced with 315D54 had a GM Modulus (i.e., 47.6 g/%) similar to that of the based sheet produced with 378G55 at 257° F. sheet temperature. It is evident that 378G55 performs well at higher sheet temperature while 315D54 can only perform as well at lower sheet temperature.

Referring to Samples 18-1 through 21-1 of FIG. 4, adding 2% of the wetting agent monoammonium phosphate (MAP) to the prior art sulfuric acid quenched adhesive (315D54) did not improve any key base sheet properties or remove edge coating build-up. Adding MAP to 315D54 results in harder coating with less re-wetability and less adhesion. This demonstrates the significant and surprising advantages of stabilizing the adhesive with phosphoric acid.

Example 5

Comparing the Effectiveness of the Phosphoric Acid Stabilized Adhesive to the Commercial PAE and PVOH Adhesives on Creping Base Sheets Comprising AKD To demonstrate the superior performance obtained with the creping adhesives of the present invention (Unicrepe PAE), a series of creping trials were performed using four different commercially available conventional creping adhesives based on PAE or PVOH at an add on rate of 4 lbs. of creping adhesive per ton of paper passed over Yankee. Creping was attempted with two base sheets: a conventional wet strength base sheet for napkin stock which was substantially free of any release/barrier material, and a barrier napkin base sheets comprising alkenyl ketene dimer in the amounts indicated. All of the creping adhesives were satisfactory with a conventional base sheet. Only the creping adhesive of the present invention was suitable for use with base sheets containing 3.25 lbs of alkenyl ketene dimer per ton of tissue. Referring to Table 4, as indicated in the comments column, the conventional creping adhesives resulted in poor creping and unstable sheets. It is believed that this result can be attributed to the very low creping force observed with each of conventional adhesives. Throughout these examples, a 5° blade bevel was used.

TABLE 4

| Example | Creping adhesive | Creping force (#/12 in.) | AKD #/ton | Comments |
|---|---|---|---|---|
| N-1 | Hercules (conventional PAE) | 1.0 | 0 | Good creping and sheet stability |
| N-2 | Hercules (conventional PAE) | 0.3 | 1.75 | Poor creping, heavy deposit on Yankee |
| N-3 | Unicrepe PAE $H_3PO_4$ Quenched | 1.4 | 0 | Good creping and sheet stability |
| N-4 | Unicrepe PAE $H_3PO_4$ Quenched | 0.8 | 3.25 | Good creping and sheet stability |
| N-5 | Solvox 4480 (conventional PAE) | 1.4 | 0 | Good creping, good sheet stability |
| N-6 | Solvox 4480 (conventional PAE) | 0.2 | 3.25 | Sheet floated, poor creping |
| N-7 | Celvol 540 | 0.8 | Zero | Good creping and sheet stability |
| N-8 | " | 0.4 | 3.25 | Poor creping, heavy deposit on Yankee |
| N-9 | Ultra crepe HT | 1 | 0 | Good creping, good sheet stability |
| N-10 | " | 0 | 3.25 | Poor creping, hard surface baked on Yankee |

The invention claimed is:

1. A method for manufacturing tissue, towel, or napkin paper from a continuous paper web fed onto the outer surface of a paper drying drum, comprising:

applying a creping adhesive composition to the outer surface of the paper drying drum, prior to the web contacting the drum surface, the adhesive comprising poly(aminoamide)-epihalohydrin creping adhesive having free amine groups acidified with phosphoric acid for converting the free amine groups to their corresponding acid salts;

contacting the creping adhesive-bearing drum surface with a continuous paper web;

drying the continuous paper web; and creping the dry continuous paper with a creping blade to form the creped tissue, towel, or napkin paper.

2. The method of claim 1 in which the poly(aminoamide)-epihalohydrin creping adhesive is a poly(aminoamide)-epichlorohydrin adhesive.

3. The method of claim 2 in which the poly(aminoamide)-epihalohydrin creping adhesive is prepared by first reacting a dibasic carboxylic acid, or its ester, half-ester, or anhydride derivative, with a polyalkylene polyamine under conditions suitable to produce a water soluble polyamide, the water-soluble polyamide is then reacted with an epihalohydrin, and acidified with phosphoric acid to a pH of 3.5-7.0 at the end of the polymerization reaction.

4. The method of claim 3 in which the poly(aminoamide)-epihalohydrin polymer is acidified with ortho-phosphoric acid.

5. The method of claim 3 in which the dicarboxylic acid, or its ester, half-ester, or anhydride derivative, is one of a saturated aliphatic dibasic carboxylic acids, ester, half-ester, or anhydride derivative, containing from about 3 to about 10 carbon atoms.

6. The method of claim 3 in which the dicarboxylic acid is adipic acid.

7. The method of claim 3 in which the epihalohydrin used in preparing the poly(aminoamide)-epihalohydrin polymer is epichlorohydrin.

8. The method of claim 3 in which the phosphoric acid acidified poly(aminoamide)-epihalohydrin creping adhesive is substantially fully cross-linked.

9. The method of claim 3 in which the water-soluble polyamide is reacted with epihalohydrin until the poly(aminoamide)-epihalohydrin is substantially fully cross-linked.

10. The method of claim 1 in which the dryer is a Yankee dryer and the creping adhesive composition is applied to the outer surface of the Yankee dryer drum.

11. The method of claim 10 in which the paper web is applied to the outer, adhesive coated surface of the drum by a carrier fabric which does not extend to one or more edges of the drum surface whereby one or both edges of the drum surface are exposed, and including the step of applying water to the said one or more exposed edges of the adhesive coated drum.

12. A method for manufacturing tissue, towel, or napkin paper from a continuous paper web fed onto the outer surface of a Yankee dryer drum, comprising:

spraying a creping adhesive composition onto the outer surface of the Yankee dryer drum prior to the web contacting the drum surface, the adhesive comprising a poly (aminoamide)-epichlorohydrin creping adhesive having free amine groups acidified with phosphoric acid for converting the free amine groups to their corresponding acid salts, prepared by first reacting adipic acid with a polyalkylene polyamine under conditions suitable to produce a water soluble polyamide, the water-soluble polyamide is then reacted with epichlorohydrin until the polymer is substantially fully cross-linked, and acidifying with ortho-phosphoric acid at the end of the polymerization reaction;

applying the paper web to the creping adhesive-bearing drum surface by a carrier fabric which does not extend to one or more edges of the drum surface whereby one or both edges of the drum surface are exposed;

spraying water or a modifier onto the said one or more exposed edges of the adhesive coated drum;

drying the continuous paper web; and creping the dry continuous paper with a creping blade to form the creped tissue, towel, or napkin paper.

* * * * *